US011338164B2

(12) United States Patent
D'Alesio

(10) Patent No.: US 11,338,164 B2
(45) Date of Patent: May 24, 2022

(54) FLEXIBLE SPORTING APPARATUS DESCRIPTION

(71) Applicant: REAXING S.R.L., Milan (IT)

(72) Inventor: Gionata D'Alesio, Milan (IT)

(73) Assignee: REAXING S.R.L., Milan (IT)

( * ) Notice: Subject to any disclaimer, the term of this patent is extended or adjusted under 35 U.S.C. 154(b) by 67 days.

(21) Appl. No.: 16/463,257

(22) PCT Filed: Nov. 22, 2017

(86) PCT No.: PCT/IB2017/057335
§ 371 (c)(1),
(2) Date: May 22, 2019

(87) PCT Pub. No.: WO2018/096470
PCT Pub. Date: May 31, 2018

(65) Prior Publication Data

US 2019/0308051 A1 Oct. 10, 2019

(30) Foreign Application Priority Data

Apr. 7, 2017 (IT) ..... 102017000038793

(51) Int. Cl.
*A63B 21/00* (2006.01)
*A63B 21/06* (2006.01)
(Continued)

(52) U.S. Cl.
CPC .... *A63B 21/00043* (2013.01); *A63B 21/0607* (2013.01); *A63B 21/00061* (2013.01);
(Continued)

(58) Field of Classification Search
CPC ..... A63B 21/4011; A63B 21/00043; A63B 21/0601; A63B 21/065; A63B 21/0607;
(Continued)

(56) References Cited

U.S. PATENT DOCUMENTS 4,690,401 A 9/1987 Cho
5,514,056 A * 5/1996 Ronca ..... A63B 21/0607 482/105

(Continued)

FOREIGN PATENT DOCUMENTS

IT WO2007/104509 * 9/2007 ..... A63B 21/055
WO WO 2007/104509 9/2007
WO WO 2016/085748 6/2016

OTHER PUBLICATIONS

International Search Report, PCT/IB2017/057335, dated Mar. 23, 2018.
Written Opinion, PCT/IB2017/057335, dated Mar. 23, 2018.

*Primary Examiner* — Loan B Jimenez
*Assistant Examiner* — Andrew M Kobylarz
(74) *Attorney, Agent, or Firm* — Nixon & Vanderhye

(57) ABSTRACT

A flexible sporting apparatus includes an elongated and flexible body (2), which can be gripped, connected to the body of a person or connected to another identical or different apparatus, wherein the body (2) includes at least one flexible connection element (10, 11, 12) extending between a first end (3) and a second end (4) of the body (2), at least for a part of its length, a plurality of masses (20, 21, 22), distributed between the first end (3) and the second end (4) of the body (2), joined integrally to the at least one connection element (10, 11, 12) so that their position, in the direction of the length of the body, is maintained substantially unchanged when the apparatus is moved or bent; and optionally a containment element (30) that surrounds the at least on connection element (10, 11, 12) and the masses (20, 21, 22).

20 Claims, 14 Drawing Sheets

(51) Int. Cl.

| | |
|---|---|
| ***A63B 21/072*** | (2006.01) |
| ***A63B 23/12*** | (2006.01) |
| ***A63B 69/00*** | (2006.01) |
| ***A63B 71/06*** | (2006.01) |

(52) U.S. Cl.
CPC ..... *A63B 21/00065* (2013.01); *A63B 21/0609* (2013.01); *A63B 21/072* (2013.01); *A63B 21/4001* (2015.10); *A63B 21/4035* (2015.10); *A63B 23/1209* (2013.01); *A63B 69/0053* (2013.01); *A63B 2071/0694* (2013.01)

(58) Field of Classification Search
CPC ..... A63B 21/4001; A63B 21/4035; A63B 21/00061; A63B 21/00065; A63B 21/0609; A63B 21/072; A63B 23/1209; A63B 69/0053; A63B 2071/0694
See application file for complete search history.

(56) References Cited

U.S. PATENT DOCUMENTS

| | | | | |
|---|---|---|---|---|
| 5,891,003 | A * | 4/1999 | Deac | A63B 21/027 482/106 |
| 7,090,624 | B1 * | 8/2006 | Chrishon | A63B 21/0601 482/105 |
| 8,597,166 | B2 | 12/2013 | Cuzzolin | |
| 2008/0051262 | A1 | 2/2008 | Striar et al. | |
| 2008/0280737 | A1 * | 11/2008 | Cook | A63B 21/065 482/105 |
| 2013/0281262 | A1 * | 10/2013 | Russotti | A63B 21/0607 482/44 |
| 2015/0031508 | A1 * | 1/2015 | Goldberg | A63B 23/1209 482/106 |

* cited by examiner 1
8
8
3
4

1
8
8
3
4

1
8
8
3
4

1
8
8
3
4

1
8
8
3
4

1
8
8
3
4

FLEXIBLE SPORTING APPARATUS DESCRIPTION

BACKGROUND OF THE INVENTION

Field of the Invention

The present invention relates to a sporting apparatus. More in particular, the invention relates to a flexible sporting apparatus that can be gripped by at least one person, attached to parts of the body or connected to another apparatus, to perform physical exercises that involve the use of different muscles of the body.

Description of the Related Art

In the sector of sporting disciplines, apparatus grippable with one or with both the hands, such as dumbbells, barbells, kettlebells or the like, are well known. These apparatus have a mass by virtue of which, by gripping the apparatus and carrying out given movements, it is possible to train the muscles of the upper part and/or of the lower part of the body.

These known apparatus generally consist of rigid and non-deformable bodies, such as rods, discs or the like that, due to their shape and rigidity, and also due to their dangerousness, limit the possibility of movement of the apparatus by the person and, therefore, the type of exercises in which they can be used.

Moreover, the aforesaid rigidity means that the centroid of said apparatus is fixed with respect to the geometry of the body. The load of these apparatus is therefore substantially stable.

A person training with these apparatus voluntarily and conditionally contracts his/her muscles to carry out a given movement typical of the exercise being performed.

In practice, during the performance of an exercise, any variation of position or speed of a part of the body, just as the force exerted by given muscles, is carried out voluntarily and consciously by the person performing the exercise.

However, in some training contexts, both at competitive and non-competitive level, and for rehabilitation, it is advantageous to be able to use apparatus or equipment that, either directly or indirectly, exert a variable or unstable, and in any case unpredictable, load on the body of the athlete or of the patient.

BRIEF SUMMARY OF THE INVENTION

The main object set and achieved by the present invention is that of providing a versatile apparatus that allows the person using it to perform a great many different exercises by gripping the apparatus directly, wearing it attached to at least one part of the body or by using it as mass to attach to another apparatus of known type.

Another object of the present invention is to provide an apparatus capable of generating motor interferences that are unpredictable, or only partially predictable, by the person performing out the exercise.

Another object of the invention is to produce a modular apparatus that can take numerous configurations of shape and of weight, so as to be usable in numerous exercises by persons of different build and prowess.

Further object of the invention is to provide an apparatus that can be used as variable and progressive mass, both on its own and attached to another known apparatus.

A further object of the present invention is to propose a sporting apparatus that is inexpensive and simple to produce.

Yet another object of the present invention is to provide a practical sporting apparatus that is also safe and practical for use by beginners or inexperienced users.

The foregoing objects are attained with a flexible sporting apparatus comprising a flexible and elongated body provided with a mass, i.e., with a weight, suitable to stimulate the strength of the muscles of a person. This body, according to the invention, is grippable in any point, with one or with both the hands, directly or with specific handles or handgrips, or can be attached to another part of the body. Moreover, the body of the apparatus can be joined to other similar apparatus to form a modular apparatus, or can be connected to a known apparatus.

According to a mode of use, the apparatus can therefore be gripped, for example, like a dumbbell, a barbell or a kettlebell. Advantageously, unlike the aforesaid known apparatus, the flexible structure of the body allows the person using the apparatus to carry out movements that also involve deformation of the apparatus and, therefore, that allow a much greater number of exercises to be performed.

Moreover, this possibility of varying the shape of the body allows the apparatus to be attached to at least one part of the body of the person, for example around the neck, the head, the torso or a limb, in a practical and comfortable manner.

According to another mode of use, as a result of its flexibility, the apparatus can also be used as progressive mass for weight lifting or other exercises that involve gradual lifting of the apparatus from the supporting surface.

This capacity of the body to flex during use, both through gravity and through its inertia, causes continuous variations of position of the centroid. The aforesaid variations, in turn, generate unpredictable motor interferences, in terms of balance and/or of effort, on the body of the person carrying out the exercise.

These unexpected stresses stimulate the neuromuscular system of the person, improving its capacity for reaction.

Naturally, the apparatus can have different weight values as a function of the exercise to be carried out or of the person who has to use it.

According to the invention, the aforesaid body comprises a plurality of masses distributed between the two ends of the body. The body further comprises at least one connection element to which some of the masses are fixed.

According to a preferred variant, said connection element is flexible and continuous. The masses, preferably all, are fixed integrally to said at least one connection element. The function of the connection element is to maintain each mass in a given position with respect to the length of extension of the body when the apparatus is moved or bent. In practice, each mass has a substantially fixed position with respect to the ends of the body and cannot move toward one or the other.

In this way, the weight value per unit of length of a given section of the body is maintained substantially unchanged.

According to the invention, the flexible apparatus can be joined to other similar apparatus, in different ways, to form a modular apparatus. The modular apparatus can therefore have a shape and weight that makes it suitable for use by different subjects and for exercises that involve movements that differ even greatly from one another.

The possibility of joining several modules of different weight together also allows a non-linear increase or decrease in load, in terms of weight, to be generated.

According to an alternative variant of the invention, the masses are joined to one another to form a linked element. The apparatus preferably comprises a plurality of said linked elements that extend between the ends of the body of the apparatus. Said linked elements are joined to one another at least at their ends, by at least one connection element.

The connection element therefore allows the masses to be maintained grouped in a bundle and the ends of the linked elements to be retained at the ends of the body of the apparatus.

The invention therefore relates to a flexible sporting apparatus comprising an elongated and flexible body, said body being grippable or connectable to at least one part of the body of a person or to another identical or different apparatus, wherein a first end and a second end of said body can be free, joined to each other or connectable to other elements. The body comprises:

a plurality of masses distributed between the first end and the second end of the body so that their position, in the direction of the length of the body, is substantially unchanged when the apparatus is moved or bent;

at least one connection element fixed to said masses.

In an aspect of the invention, said at least one connection element, generally continuous, is flexible and extends between said first end and said second end at least for a part of the length of the body.

The masses are fixed to said at least one connection element so as to maintain their position substantially unchanged, in the direction of the length of the body, when the apparatus is moved or bent.

According to some variants of the invention, the body can further comprise a containment element that surrounds said at least one connection element and said masses.

According to a variant of the invention, said masses can be distributed in the body uniformly so that the weight per unit of length of the body is substantially constant between the first end and the second end.

Alternatively, the masses can be distributed according to a predetermined pattern, or also randomly, so that different sections of the body have a different weight per unit of length. This allows, during the performance of some movements, a destabilizing effect to be obtained on the person due to the different inertias of the single sections with different weight.

According to an aspect of the invention, the masses can be the same as or different from one another. In particular, the masses can be the same in shape, dimension, weight and material, or can differ in at least one of the aforesaid characteristics.

According to the invention, said masses can have the shape of any solid; preferably they have the shape of a spheroid, ring, cylinder, disc or parallelepiped.

The material of the aforesaid masses is preferably selected from heavy materials, mainly metals.

According to another aspect of the invention, the body can comprise a plurality of connection elements maintained grouped in a bundle by the containment element. Each connection element carries one or more of the aforesaid masses. When the apparatus is completely extended, the masses are arranged along rows substantially parallel to one another.

The connection elements are preferably joined to one another at their ends and optionally in further intermediate points. Typically, the connection element, whether single or more than one, has the same length as the body. Therefore, the ends of the connection element are substantially coincident with the ends of the body.

According to an aspect of the invention, the connection element can comprise, for example, a wire, a rope, a cable, a tape or other equivalent flexible elements. Preferably, the connection element is substantially inextensible.

The connection element can be made of various materials, such as natural or synthetic fibres, polymers or metal.

According to the invention, the body can comprise several connection elements, the same as one another or different in type and material.

According to another aspect of the invention, the apparatus comprises a flexible reinforcing element that extends between the ends of the body. Optionally, some of the masses can also be secured to said reinforcing element.

According to another variant of the invention, the connection element can comprise a solid and deformable matrix in which the masses are dispersed. Said matrix preferably has the shape of an elongated element that has the same length as the body of the apparatus. A single matrix can form the whole section of the body or, alternatively, several matrices can be grouped in a bundle.

The material of the matrix is preferably chosen from a gel, a silicone, an expanded polymer material or equivalent materials capable of ensuring that the apparatus has adequate flexibility and at the same time maintaining the masses in suspension in a given position of the body.

According to another aspect of the invention, the outer surface of the body can have zones indicated with marks or differently coloured. Said marks or colours can distinguish sections of the body that have a different specific weight per unit of length. Said zones can also indicate gripping zones in which the apparatus can be gripped in a balanced way, or unbalanced toward one of its ends.

According to another variant of the invention, the apparatus comprises a plurality of masses joined to one another to form a plurality of said linked elements that extend between the ends of the body of the apparatus. Said linked elements are joined to one another at least at their ends by a connection element.

According to an aspect of the invention, said masses are substantially ring or hook shaped or the like, so as to be able to be connected consecutively to one another in a stable or releasable manner.

According to the invention, the connection element has a shape suitable to encircle or enclose a length of the linked elements so as to maintain them aligned and close to one another.

According to a possible embodiment, the connection element can comprise a clamp or a bushing in which an end length of the linked elements is housed. Alternatively, the connection element can comprise a body in which said end lengths are embedded.

As already mentioned, in this variant, the connection element has the task of maintaining the linked elements grouped in a compact bundle and of maintaining their ends aligned with each other and at the ends of the body of the apparatus.

In an aspect of the invention, the apparatus can comprise further connection elements interposed between those at the ends of the body.

According to another aspect of the invention, the body, at least at one end, can comprise a connection means. Preferably, said connection means is provided both at the first and at the second end of the body. Said connection means allow the ends to connect to one another or to connect the flexible apparatus to other flexible apparatus or to other different apparatus.

Therefore, the invention also concerns a modular apparatus comprising two or more flexible apparatus joined to one another.

According to a possible variant, the bodies of said apparatus can be joined in sequence so as to form a linear element.

According to an aspect of the invention, the ends of two bodies can be joined directly with the connection means or by means of at least one interconnection element interposed between them. Said interconnection element can be made of a rigid or flexible material, optionally elastic.

The interconnection element can have different shapes. Said element can join several ends of different bodies, for example three, four or more, so as to produce modular apparatus with different shapes. The connection element can, for example, be in the shape of a ring, of a Y, of a double Y, of an X or many others.

According to another possible embodiment, the modular apparatus can comprise two or more flexible apparatus in which the first end and the second end of each body are joined to one another to form an annular element. According to a first variant, each annular element is joined to at least one other by an interconnection element. Said interconnection element can slide along the body or can be fixed in one point. Typically, said interconnection element is structured so as to encircle at least two bodies to maintain them close together.

According to another variant, said annular elements are joined in a manner linked to one another. The modular apparatus can therefore take the shape of a simple chain or other more complex shapes.

According to another aspect of the invention, the modular apparatus can comprise flexible apparatus, the same as one another or different in weight and/or in shape.

BRIEF DESCRIPTION OF THE DRAWINGS

Further features and details of the invention will be better understood from the description below, provided by way of non-limiting example, and from the accompanying drawings, wherein.

DETAILED DESCRIPTION OF THE PREFERRED EMBODIMENTS

Figure 1:
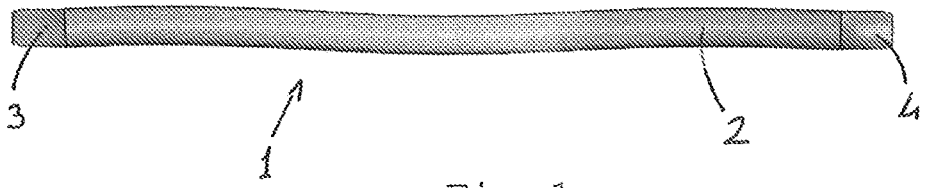
FIG. 1 is a diagram of a perspective view of the flexible apparatus according to an embodiment of the present invention.

With reference to FIG. 1, this illustrates the flexible sporting apparatus 1, which comprises an elongated and flexible body 2. Within the scope of the present invention, the term elongated means that the body has one dimension, for example the length, much greater than the others, for example the height and the width. Instead, the term flexible means the capacity of the body to flex with respect to an extended position in which it is substantially rectilinear. According to the invention, the body 2 is sufficiently flexible to be able to be bent in a ring or in a U. Preferably, in this latter case, the two arms of the U can be brought into contact with each other substantially for the whole length.

This bending capacity, as already mentioned, allows the apparatus to be used to perform a wide variety of exercises that usually require the use of several different known apparatus. The body 2 can in fact be gripped with one or with both hands, in any point between a first end 3 and a second end 4, these latter included.

The body 2 can also be worn by the person, also without the aid of further fastening means such as belts, harnesses or the like. In fact, due to the fact that it deforms easily, the body 2 can for example be wrapped around a part of the body of the person.

The weight and the dimensions of the body 2 can vary as a function of the user's needs. The person performing the exercise will choose the apparatus with a weight and with dimensions compatible with his/her physical capacities and with the movements required by the exercise.

Typically, the body 2 has a weight comprised between 0.5 kg and 5 kg, although higher or lower weight values than those indicated are possible.

Preferably, the body 2 has a section of constant shape and dimension between the first end 3 and the second end 4.

This allows the body 2 to be gripped comfortably in any point between the aforesaid ends 3, 4.

For this purpose, the maximum dimension of the section of the body 2 is preferably less than 60 mm and more preferably less than 40 mm. Typically, the minimum dimension of said section is at least 10 mm.

According to a preferred embodiment, the shape of the section of the body 2 is substantially circular. This shape guarantees a substantially constant bending strength of the body regardless of the position of the body with respect to the plane of bending.

The diameter of the section is typically comprised between 15 mm and 40 mm and more preferably between 20 mm and 30 mm.

However, the section can also have other shapes, for example it can be oval or flattened or have the shape of any polygon. Such shape of the section can give the body 2 a different bending strength with respect to different planes of bending.

The length of the body 2 is preferably comprised between 200 mm and 1500 mm and more preferably between 500 mm and 800 mm.

With reference to FIGS. 2*a*-2*f*, these illustrate the flexible apparatus 1 according to some embodiments.

The body 2 of the apparatus comprises a plurality of flexible connection elements 10 that extend in the direction of the length of the apparatus. Each connection element 10 carries a plurality of masses 20. The masses 20 are secured to the connection element 10 in a stable manner. In practice, the masses 20 cannot slide on said connection element.

The connection elements 10 and the masses 20 are grouped in a compact bundle, preferably retained by a containment element 30. In the example illustrated, the containment element 30 is a flexible tubular sheath. Preferably, the connection elements 10 have the same length as the body 2. The respective ends of these connection elements 10 can therefore be joined to one another, at the ends 3, 4 of the body 2.

According to a preferred variant, the connection elements 10 comprise wires, cables or ropes. They can be made of plastic material, for example nylon, or metal, or of natural or synthetic fibres. Preferably, the connection elements 10 are made of a limitedly extensible material, typically not elastic. In this way, it is guaranteed that each mass 20 remains in a given position with respect to the ends 3, 4 of the body 2, even when the apparatus is moved, pulled bent, etc. In practice, the connection element 10 prevents a mass 20 from moving toward one end of the body 2, or moving away from the other, during use of the apparatus. For example, this prevents the masses 20 from being able to accumulate in a given zone of the body 2 following given movements imparted to the apparatus, or through gravity, centrifugal force or other inertial forces. Therefore, the apparatus has a definite and stable distribution of the masses 20.

In the examples of FIGS. 2*a*-2*f*, said masses 20 comprise substantially spherical elements, for example balls. However, as already mentioned, the masses can have any other shape compatible with the capacity to bend of the body 2. The material of the masses 20 is preferably a metal, such as lead, steel or other heavy metals. However, inexpensive materials that are easy to work, such as lead, are preferable. Said masses 20 can have the same or a different shape and dimension.

According to a preferred variant, the containment element 30 is made of a plastic material. Other suitable materials are, for example, rubber, polyurethane foams, silicone, natural materials such as cotton fibres or acrylic materials. The containment element 30 allows the body 2 to bend freely maintaining the connection elements 10 and the related masses 20 grouped.

Figure 2A:
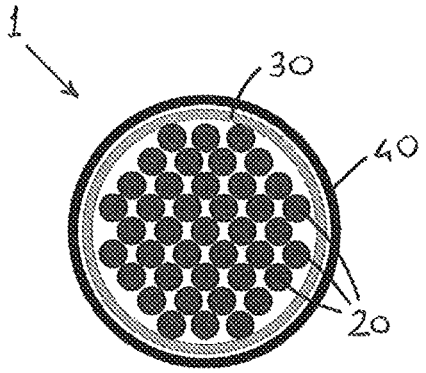
FIG. 2*a* is a cross sectional schematic diagram of the apparatus according to an embodiment of the present invention.
Figure 2B:
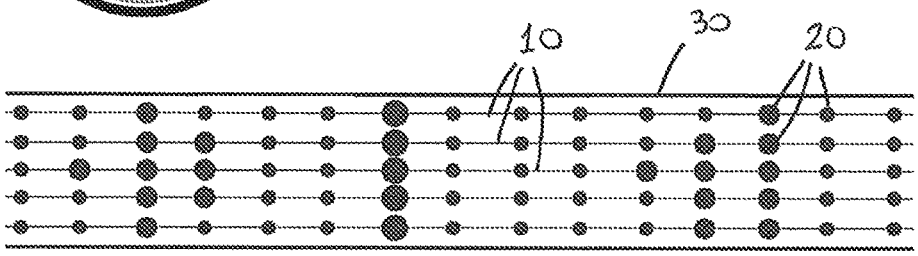
FIGS. 2*b* to 2*f* are the same number of cross sectional schematic diagrams of a portion of the apparatus according to some embodiments of the present invention.

FIGS. 2*b* to 2*f* illustrate some non-limiting examples of arrangement of the masses 20 on the connection elements 10. In FIG. 2*b* the masses 20 have a substantially constant and equal distance on all the connection elements 10. The masses 20 have a different dimension from one another, thus being able to define, if made of the same material, sections of the body 2 that are heavier than others.

Figure 2C:
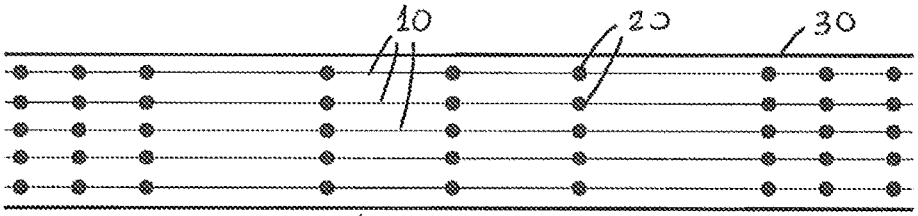
Figure 2D:
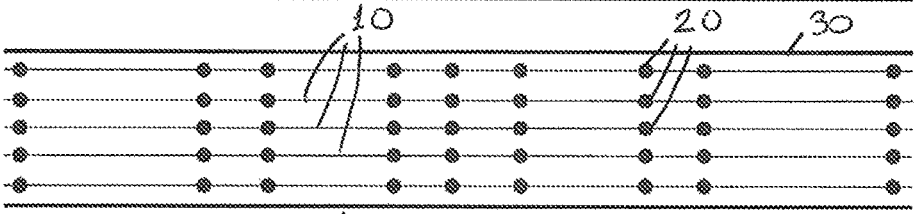

In the examples of FIGS. 2*c*, 2*d* the same result is obtained by spacing the masses 20 closer or farther apart on the connection element in some lengths of the body 2.

Figure 2E:
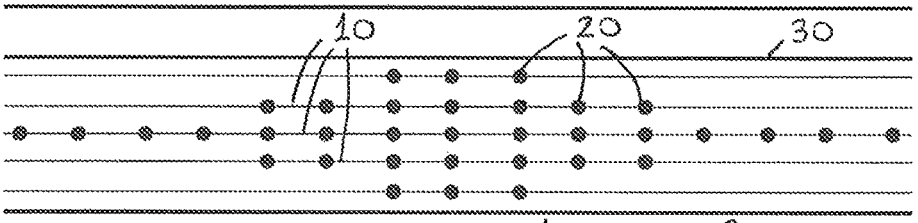
Figure 2F:
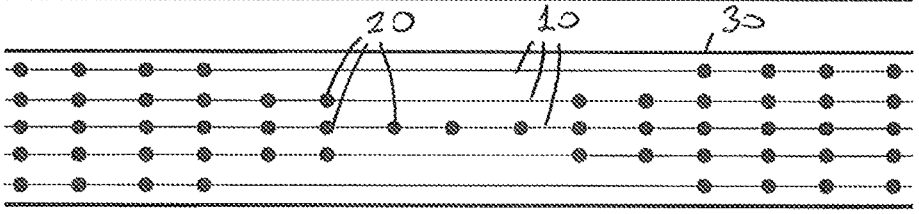
Figure 3A:
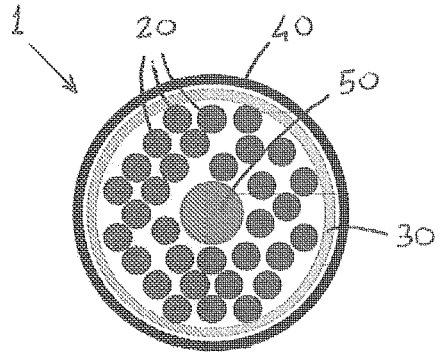
FIG. 3*a* is a cross sectional schematic diagram of the apparatus according to a further embodiment of the present invention.
Figure 3B:
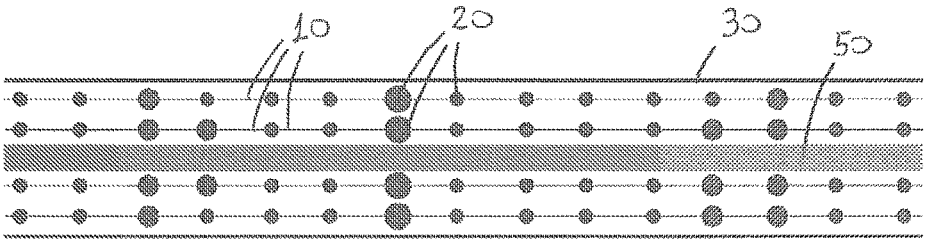
FIGS. 3*b* to 3*f* are the same number of longitudinal sectional schematic diagrams of a portion of the apparatus according to further embodiments of the present invention.
Figure 3C:
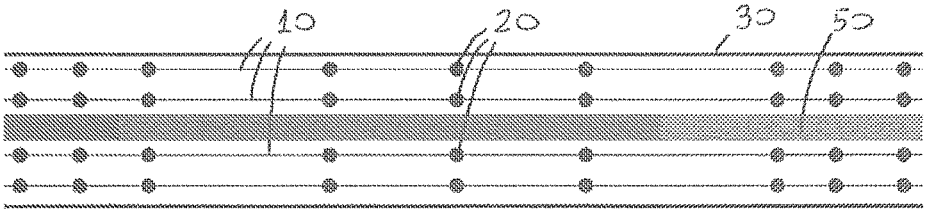
Figure 3D:
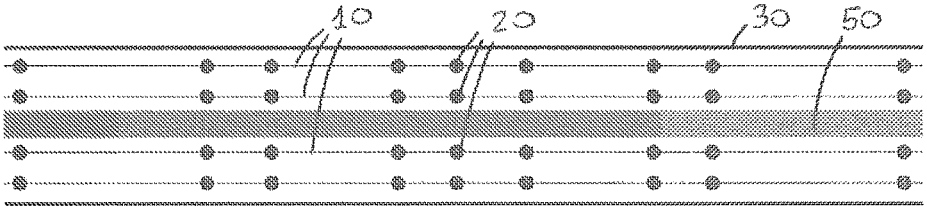
Figure 3E:
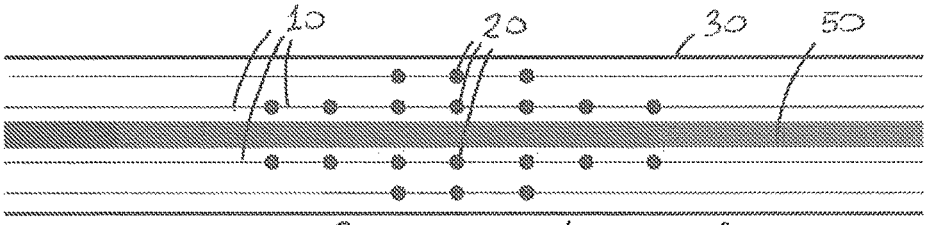
Figure 3F:
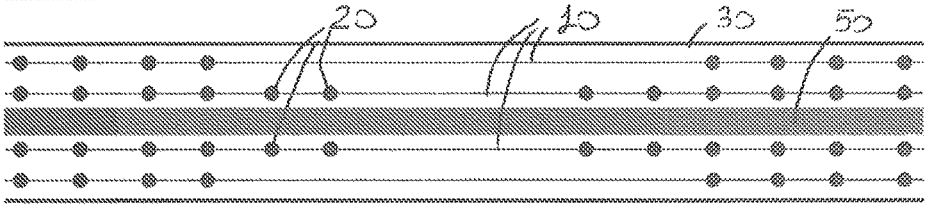
Figure 4A:
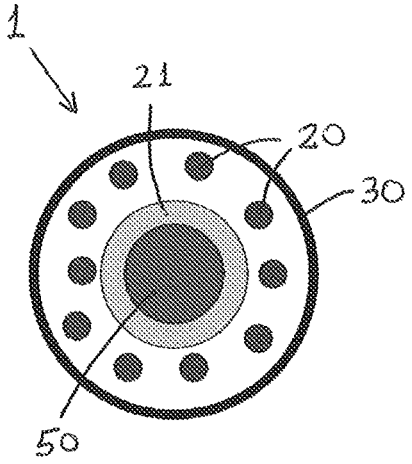
FIG. 4*a* is a cross sectional schematic diagram of the apparatus according to a further embodiment of the present invention.
Figure 4B:
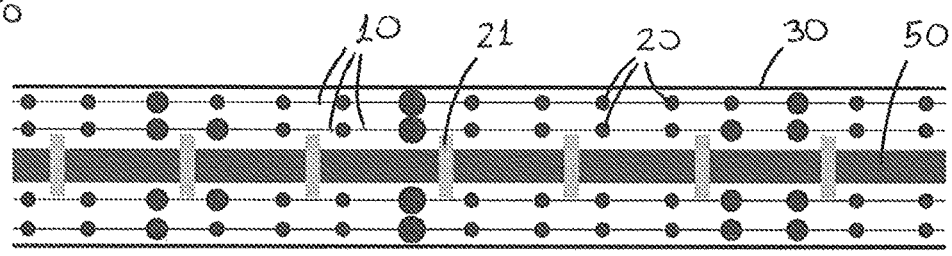
FIGS. 4*b* to 4*f* are the same number of longitudinal sectional schematic diagrams of a portion of the apparatus according to further embodiments of the present invention.
Figure 4C:
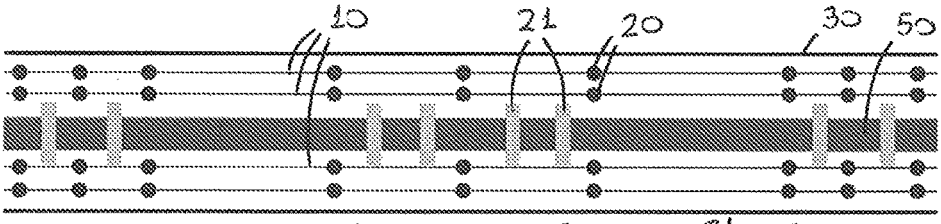
Figure 4D:
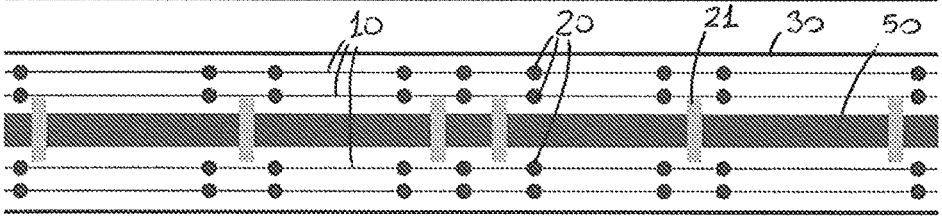
Figure 4E:
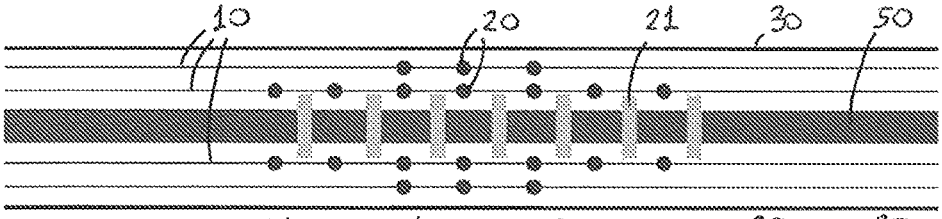
Figure 4F:
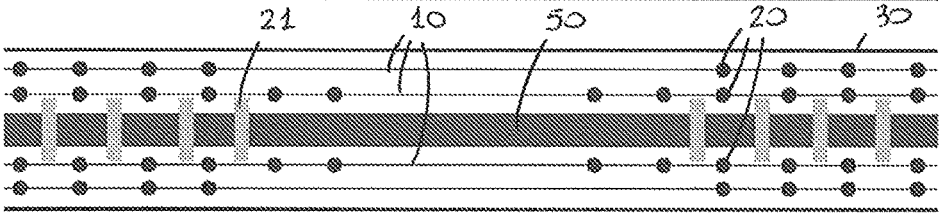

In the example of FIGS. 2*e* and 2*f*, in a given section of the body 2, the connection elements 10 carry a different number of masses 20. This configuration allows the creation of sections with a weight per unit of length that increases or decreases gradually.

According to a further variant of the invention, not illustrated in the figures, the connection element can also carry filling elements. Said filling material is preferably made of a material considerably lighter than the material of the masses, in general almost negligible. Said filling elements can be attached to lengths of the connection elements 10 without the masses 20. The function of these elements is to fill sections of the body 2 in which the masses 20 are absent or are much fewer with respect to others, in order to give the body 2 a section of substantially constant dimension between the ends 3, 4. Said filling elements can, for example, be made of a plastic material, preferably expanded, or natural fibres such as cotton or kapok.

As illustrated in FIG. 2*a*, the body 2 can also comprise an external covering element 40. The function of this covering element is to protect the containment element 30 from wear and dirt.

The function of the covering element 40 is also to limit friction between the surfaces of the apparatus and parts of the body of a person, making use more comfortable.

To this end, the covering element 40 is preferably made of acrylic materials or nylon fibres.

More in general, this covering element 40, just as the containment element 30 when provided as outermost layer, is made of a material that can be washed or in any case sanitized in a practical and rapid manner, for example using suitable liquid products.

FIGS. 3*a*-3*f* illustrate the apparatus 1 according to a further embodiment of the invention.

The apparatus, in this further variant, comprises a flexible and elongated reinforcing element 50, which extends between the ends 3, 4 of the body 2. This reinforcing element has the main task of supporting the tensile stresses to which the apparatus is subjected.

This variant is preferable when the body has a high weight and, in particular, when the apparatus is used in a modular configuration, as illustrated better below.

The reinforcing element 50 can comprise, for example, a rope, a cable, a chain or the like. Preferably, said reinforcing element is arranged at the centre of the section of the body 2 and is surrounded by the connection elements 10.

The arrangement of the masses 20 and of the connection elements 10 can be the same as described with reference to the examples of FIGS. 2*a*-2*f*.

FIGS. 4*a* to 4*f* illustrate other examples of the apparatus 1 according to a further embodiment of the invention.

With respect to the previous variant, in this variant the masses 21 are attached integrally also to the reinforcing element 50. In practice, said reinforcing element 50 also acts as connection element.

The masses 21 attached to the reinforcing element 50, generally thicker with respect to the connection elements 10, can have the shape of perforated discs or cylinders.

FIGS. 5*a* to 5*f* illustrate other examples of the apparatus 1 according to a further embodiment of the invention.

In this variant the body 2 comprises only one connection element 11 to which the masses 21, 22 are attached integrally. Preferably, according to this variant, the connection element 11 has a tensile strength comparable to that of a reinforcing element.

Figure 5A:
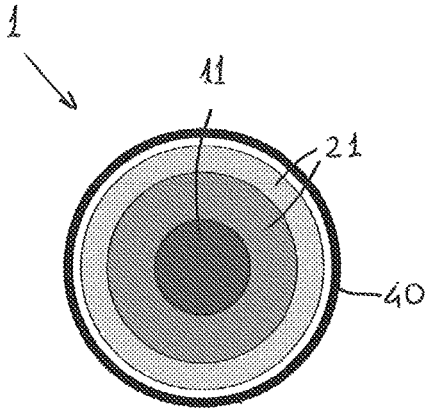
FIG. 5*a* is a cross sectional schematic diagram of the apparatus according to a further embodiment of the present invention.
Figure 5B:
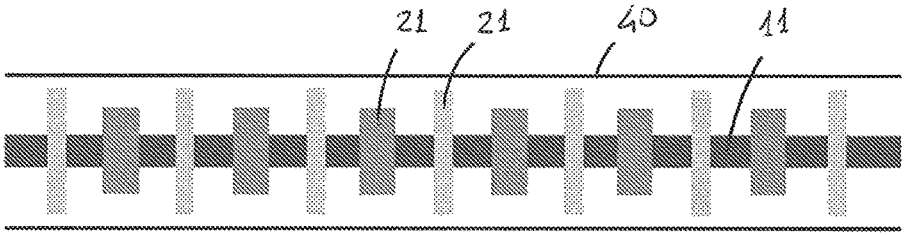
FIGS. 5*b* to 5*f* are the same number of longitudinal sectional schematic diagrams of a portion of the apparatus according to further embodiments of the present invention.
Figure 5C:
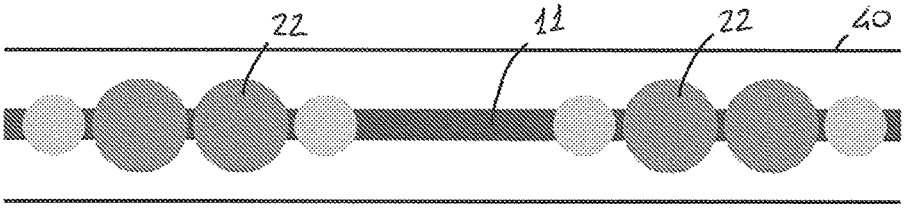
Figure 5D:
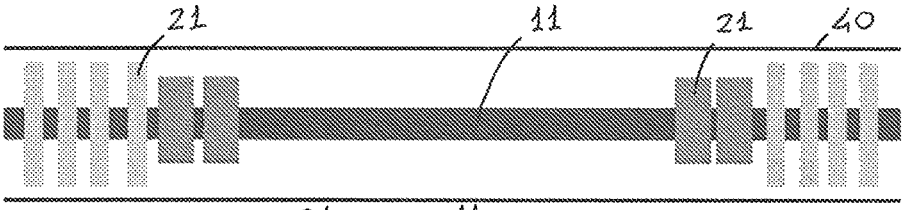
Figure 5E:
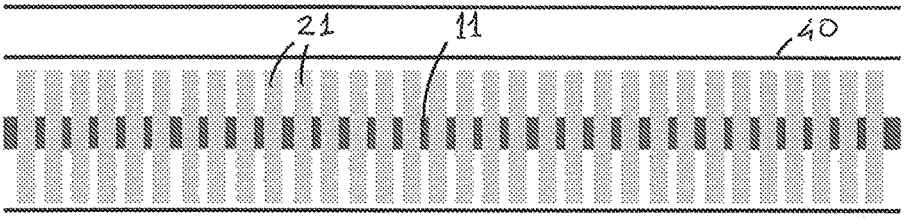
Figure 5F:
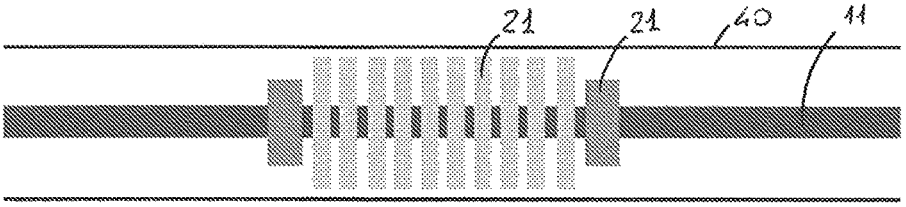
Figure 6A:
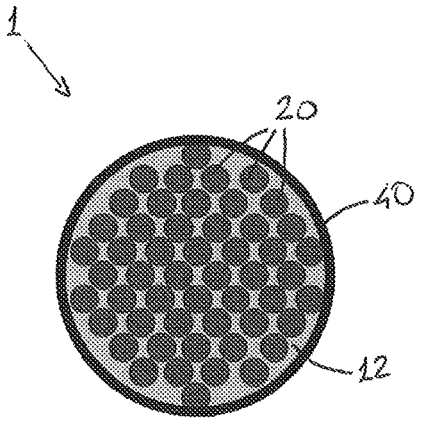
FIG. 6*a* is a cross sectional schematic diagram of the apparatus according to a further embodiment of the present invention.
Figure 6B:
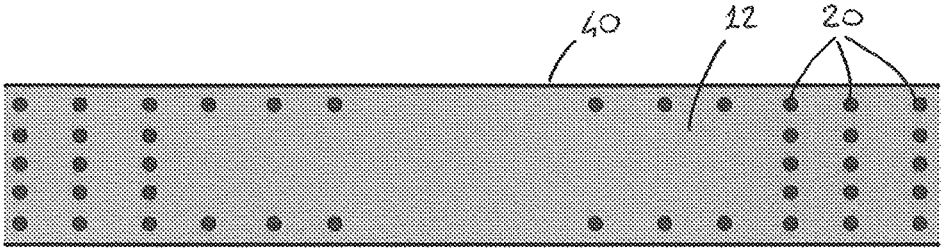
FIGS. 6*b* to 6*e* are the same number of longitudinal sectional schematic diagrams of a portion of the apparatus according to further embodiments of the present invention.
Figure 6C:
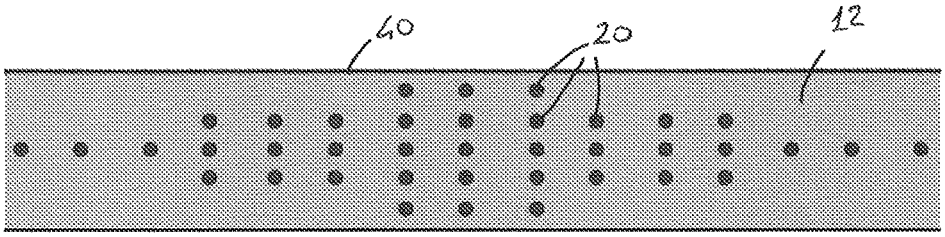
Figure 6D:
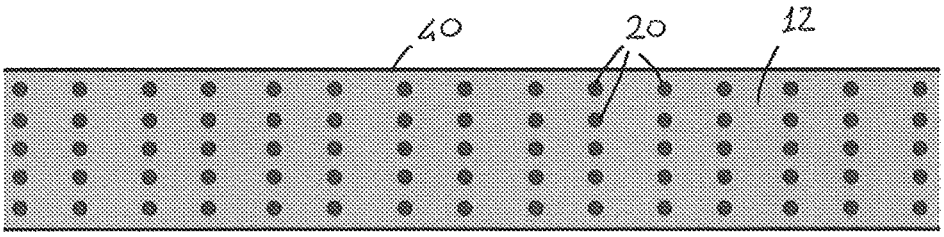
Figure 6E:
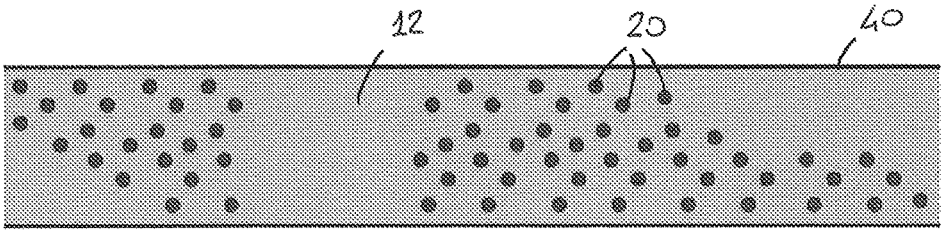

The masses 21, 22 can be discs or cylinders, as shown in FIGS. 5*b*, 5*d*-5*f*, or balls as illustrated in FIG. 5*c*.

Also in this case, the arrangement of the masses 21, 22 on the connection element 11 is chosen as a function of needs. The masses 21 can be attached at a constant distance, as in the examples of FIGS. 5*b* and 5*e*, or at a different distance. The masses 21, 22 can also be positioned only in some sections of the body 2, as in the examples of FIGS. 5*c* and 5*f*.

In this variant the containment element 30 might not be present. Optionally, the masses 21, 22 and the connection element 11 can be covered by the covering element 40.

Another variant of the apparatus 1 is illustrated in FIGS. 6*a*-6*e*. In this variant, the connection element comprises a solid and deformable matrix 12 in which the masses 20 are dispersed. The material of the matrix 12 can be a gel, an expanded polymer material, a silicone, rubber or equivalent materials.

More in general, the matrix 12 can comprise any solid material whose deformation can take place with a substantially negligible effort with respect to the effort required to overcome the weight force of the apparatus. At the same time, the structure of the matrix 12 must be sufficiently stable to maintain the masses 20 suspended in a given position of the body 2. The aforesaid masses can have a regular and uniform distribution in the direction of the length of the body 2, as in the example of FIG. 6*d*, or random as in FIG. 6*e*.

Figure 13:
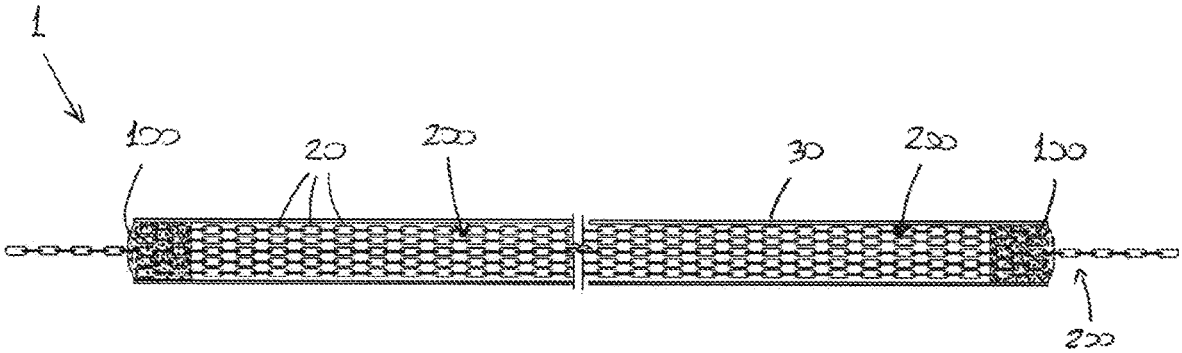
FIG. 13 is a cross sectional schematic diagram of the flexible apparatus according to a further embodiment of the present invention.

FIG. 13 illustrates another variant of the flexible apparatus according to the invention. In this variant the masses 20 comprise elements connected to one another to form a plurality of linked elements 200. Said masses are for example annular elements, hook-shaped or with any other shape that allows their connection also in the absence of other constraining means. According to a preferred example of embodiment, the masses 20 are the links of a chain 200.

According to the invention, the apparatus comprises at least one pair of connection elements 100 arranged at the ends 3, 4 of the body 2.

Said connection elements 100 retain the ends of the linked elements 200. In the example illustrated, the connection element 100 comprises a body made of plastic material, and more preferably polymer, in which the end lengths of the linked elements 200 are embedded.

Alternatively, the connection element 100 can comprise an elastic ring, a clamp or equivalent means.

In the case in which the length of the body 2 makes this necessary, further connection elements 100, not illustrated, can be arranged in intermediate points of the body 2 around the linked elements 200.

According to a preferred variant, one of the linked elements 200 can have one or both ends that extend beyond the ends of the body 2 to allow connection of the apparatus 1 to other apparatus, as will be described in more detail below.

According to another aspect of the invention, the outer surface of the body 2 can have marks or differently coloured portions, as illustrated in FIGS. 7*a*-7*f*.

Figure 7A:
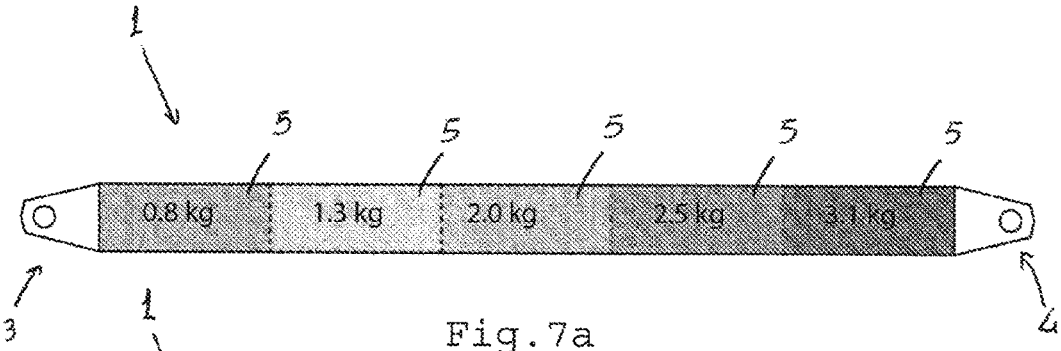
FIGS. 7*a* to 7*d* are the same number of front schematic diagrams of the apparatus according to further embodiments of the present invention.
Figure 7B:
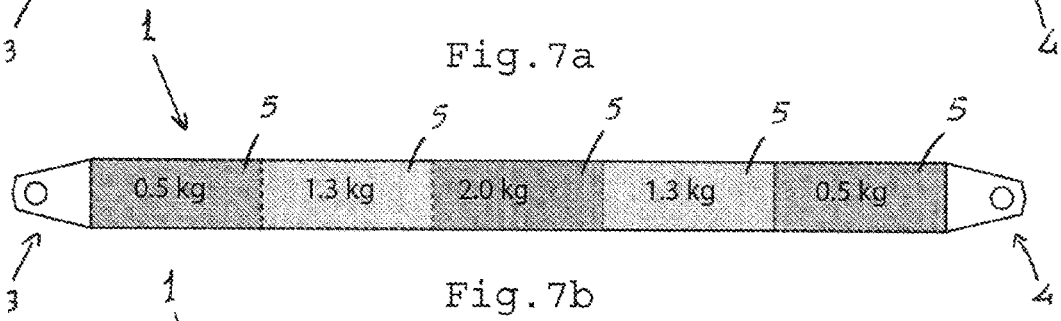

For example, with reference to FIGS. 7*a* and 7*b*, the outer surface of the body 2 has sections 5 of different colour. In the example given, the coloured sections 5 correspond to respective lengths of the body 2 that have a different weight. Optionally, besides colour, the surface of the body 2 can also bear an indication of the weight value of each section.

Therefore, the person using the apparatus can decide in which point to grip the body 2 to perform the exercise. In fact, different gripping points cause different reactions on the limb or limbs involved in the exercise, reactions linked mainly to the different inertias of the masses of the various sections involved that can be unbalanced.

Figure 7C:
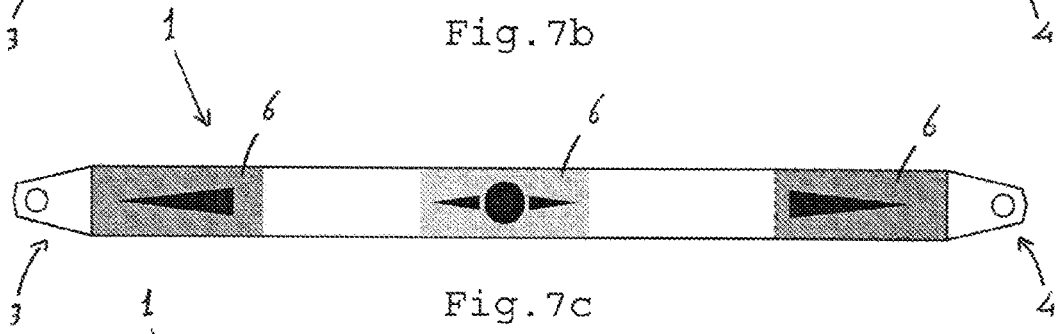
Figure 7D:
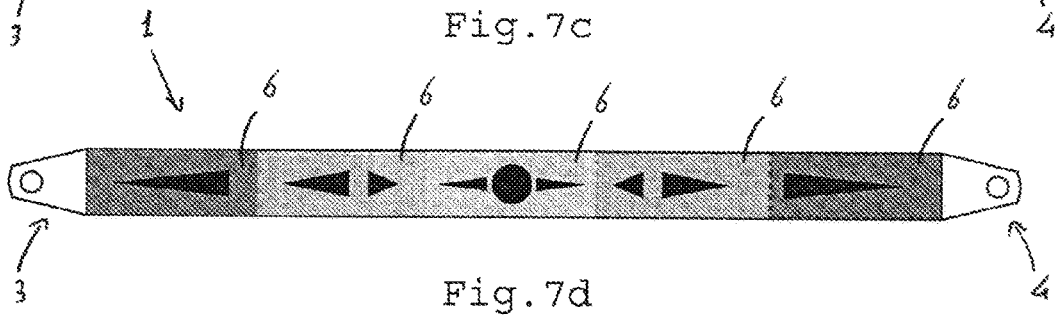

According to another variant, illustrated in the examples of FIGS. 7*c* and 7*d*, the surface of the body 2 has marks within gripping zones 6, coloured parts, or both, to highlight the gripping zones 6. Each gripping zone 6 corresponds to a holding point in which the apparatus is balanced, for example when gripped in one hand, or is unbalanced towards one of the ends.

More in general, the outer surface of the apparatus can bear letters, numbers or other marks useful for identifying and immediately recognizing different gripping zones of the apparatus so as to be able to perform exercises correctly according to the instructions provided by a trainer or by a manual.

Said marks or colours can be indicated directly on the covering element 40 or on the containment element 30, where provided as outermost layer, or attached over these latter in another way.

Advantageously, according to an aspect of the invention, the body 2 is provided at least with one connection means at least at one end 3, 4. Preferably, both said ends 3 and 4 of the body 2 are provided with the aforesaid connection means.

This connection means allows the flexible apparatus, to be joined, directly or indirectly, to other flexible apparatus to form a modular apparatus.

FIGS. 8*a*-8*f* illustrate some possible embodiments of the connection means.

Figures 8A, 8B, 8C, 8D, 8E, 8F:
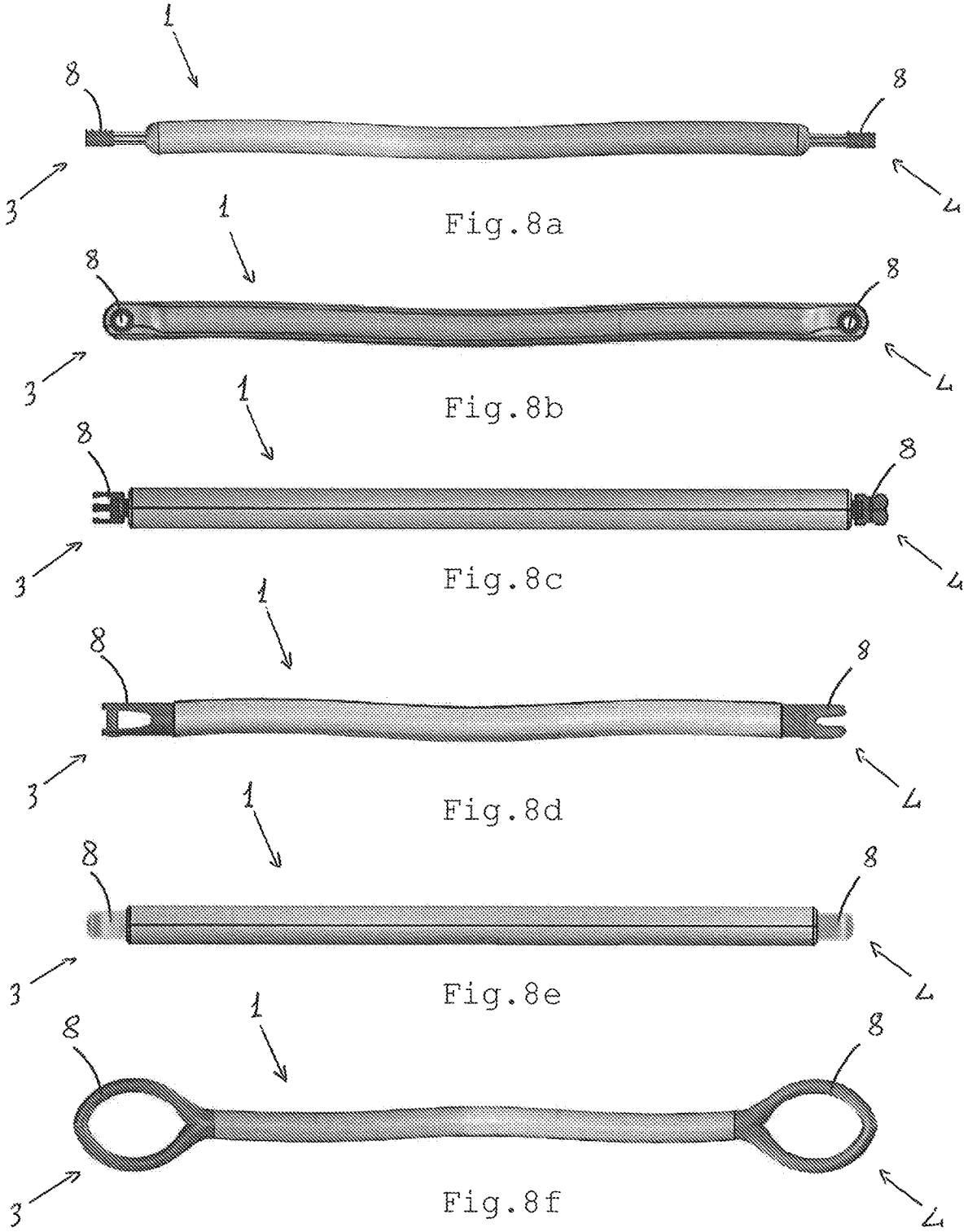
FIGS. 8*a* to 8*f* are the same number of front schematic diagrams of the apparatus according to further embodiments of the present invention.

In the example in FIG. 8*a*, the connection means 8 comprises an eyelet. Said eyelet is preferably secured on a projecting end flap of the containment element 30 or of the covering element 40.

In the example in FIG. 8*b* the connection means 8 comprises a male or female threaded element.

In the example in FIG. 8*c* the connection means 8 comprises a snap fastener or interlocking automatic closing part.

In the example in FIG. 8*d* the connection means 8 comprises an articulated joint part.

In the aforesaid examples of FIGS. 8*b*-8*d*, the connection means 8 positioned at the respective ends 3, 4 are couplable to one another to form an annular element or to join various bodies 2 in a linear sequence, as illustrated below.

In the example of FIG. 8*e* the connection means 8 comprises a loop.

In the example of FIG. 8*f* the connection means 8 comprises a ring element, typically flexible and optionally elastic. Said ring element can be tied to another identical element on the opposite ends of the body 2 or to another ring element of another body 2.

According to another variant, said connection means can comprise a length of the reinforcing element 50 (not illustrated in the figure) or of a linked element 200 (FIG. 13) that extends beyond each of the ends 3, 4 of the body 2.

Figures 9A, 9B, 9C:
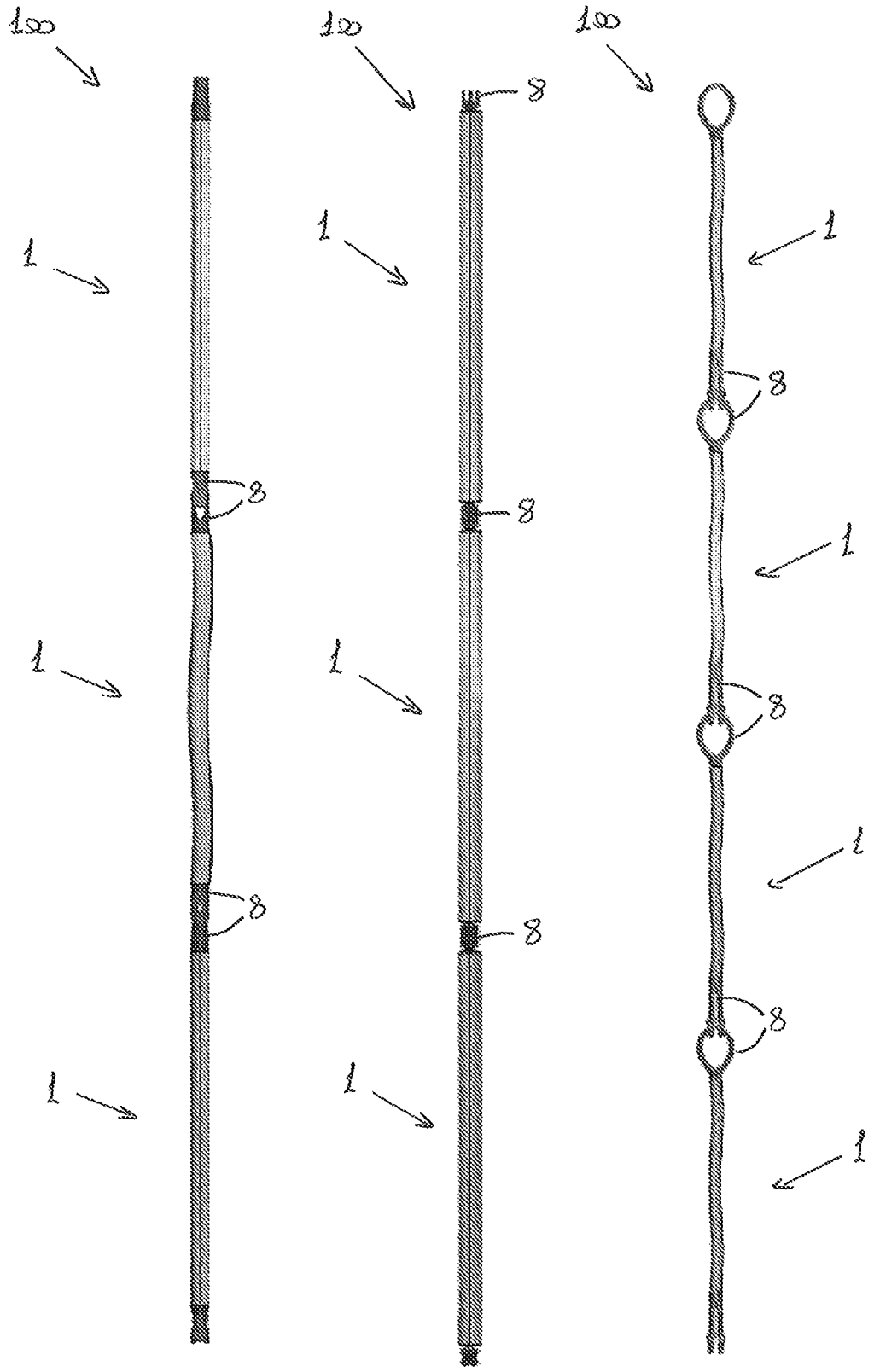
FIGS. 9*a* to 9*g* are the same number of front schematic diagrams of a modular apparatus according to some embodiments of the present invention.

FIGS. 9*a*-9*c* illustrate some examples of a modular apparatus 100 according to the invention, comprising several flexible apparatus 1 joined in sequence to form a linear element.

In the aforesaid figures, connection between the bodies 2 of the various apparatus is produced respectively by means of the articulated joint, the snap fastener or ring elements tied to one another.

In the examples of FIGS. 9*d*-9*g* the modular apparatus 100 comprises several apparatus 1 connected to one another with the aid of interconnection means 60.

Said interconnection means 60 can for example comprise snap hooks, elastic tapes, elastic rings, cables, ropes or the like.

The task of the aforesaid interconnection means 60 is to give the modular apparatus the possibility of movement, between one apparatus 1 and another, substantially equivalent, or optionally greater, with respect to the movement of the body 2. Elastic interconnection elements introduce a further degree of freedom to the apparatus, allowing it to stretch or retract while performing the exercises.

Figures 9D, 9E, 9F, 9G:
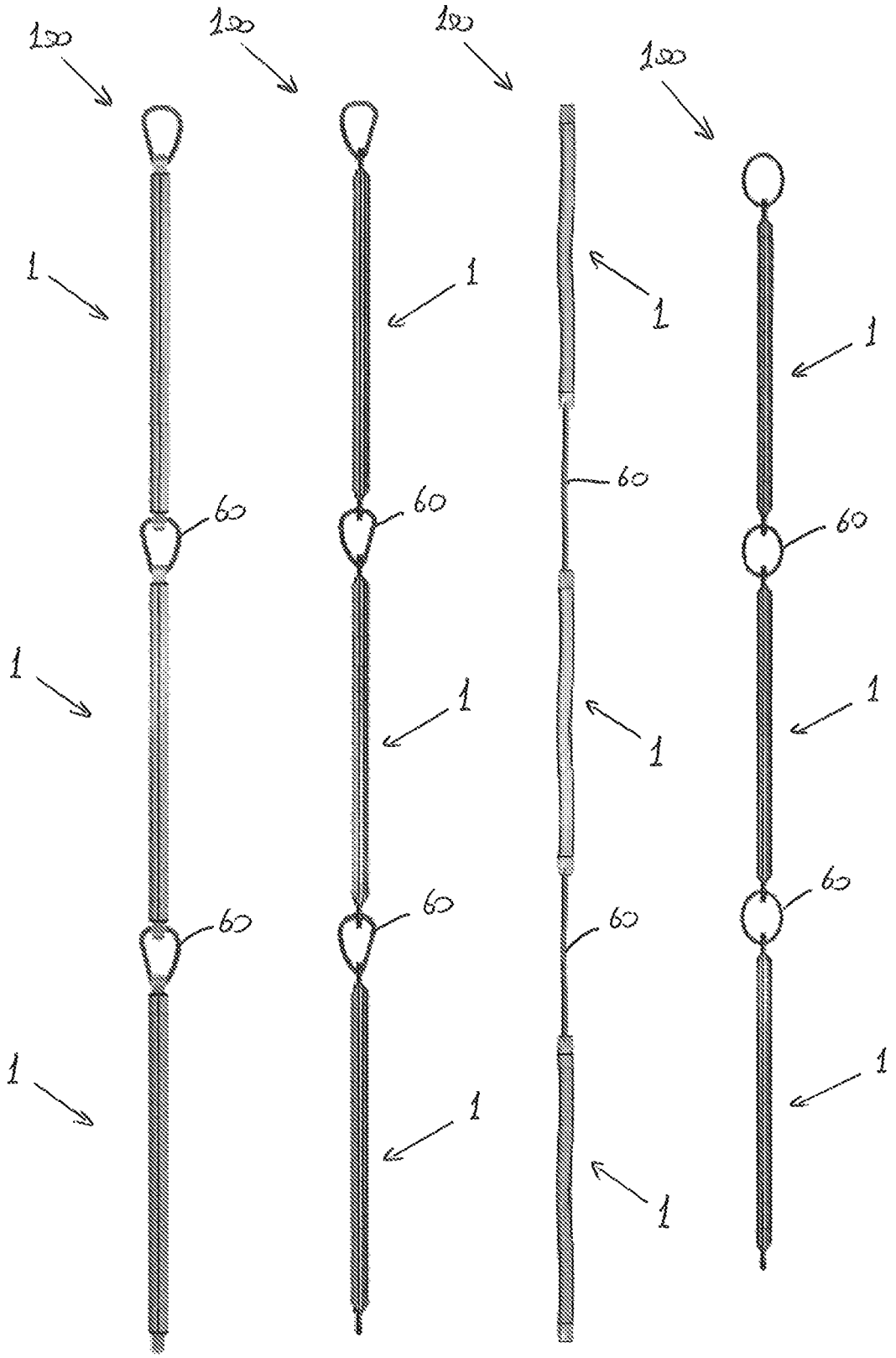

In the example of FIG. 9*e* the connection means 8 is an eyelet and the interconnection element 60 is a snap hook.

In the example of FIG. 9*f* the connection means 8 is an eyelet and the interconnection element 60 is an elastic tape.

In the example of FIG. 9*g* the connection means 8 is an eyelet and the interconnection element 60 is an elastic ring.

In the example of FIG. 9*d* the connection means 8 is a loop and the interconnection element 60 is a snap hook.

According to the invention, the modular apparatus 100 can comprise several apparatus 1 connected to one another in a non-linear manner, for example linked.

Figure 10A:
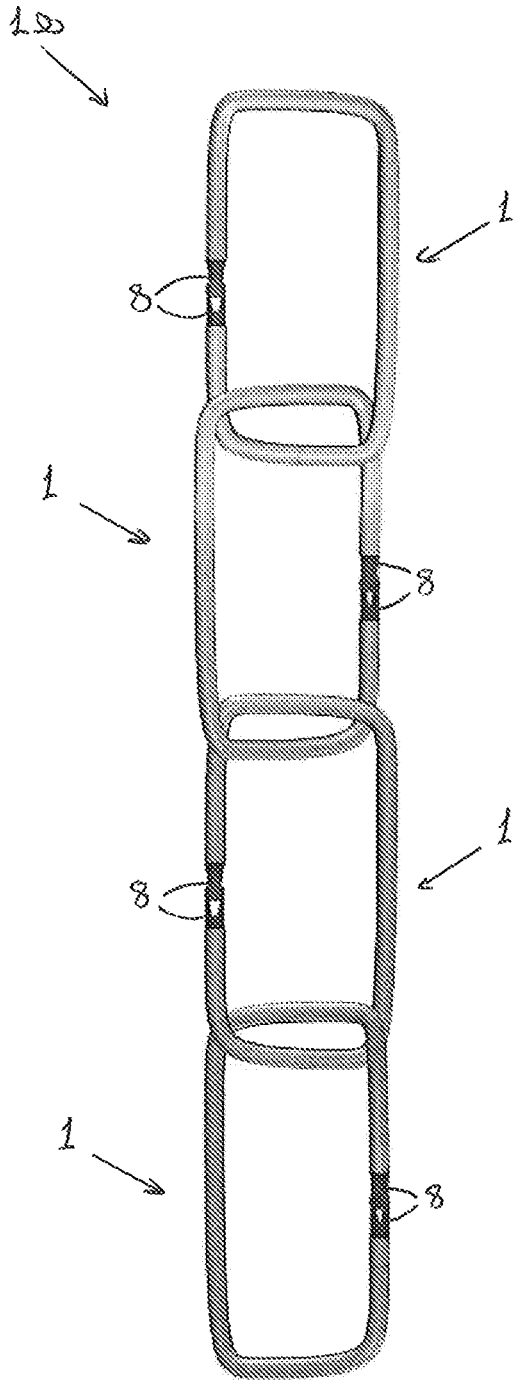
FIGS. 10*a* to 10*d* are schematic front views of the modular apparatus according to further embodiments of the present invention.

In the example of FIG. 10*a*, the apparatus 100 comprises several apparatus 1 whose bodies 2 are closed at the ends to form an annular element. Each body is linked with at least another to form a simple chain. In the example shown, the connection means 8 is an articulated joint but can also be obtained with a snap fastener or with a threaded joint.

Figure 10D:
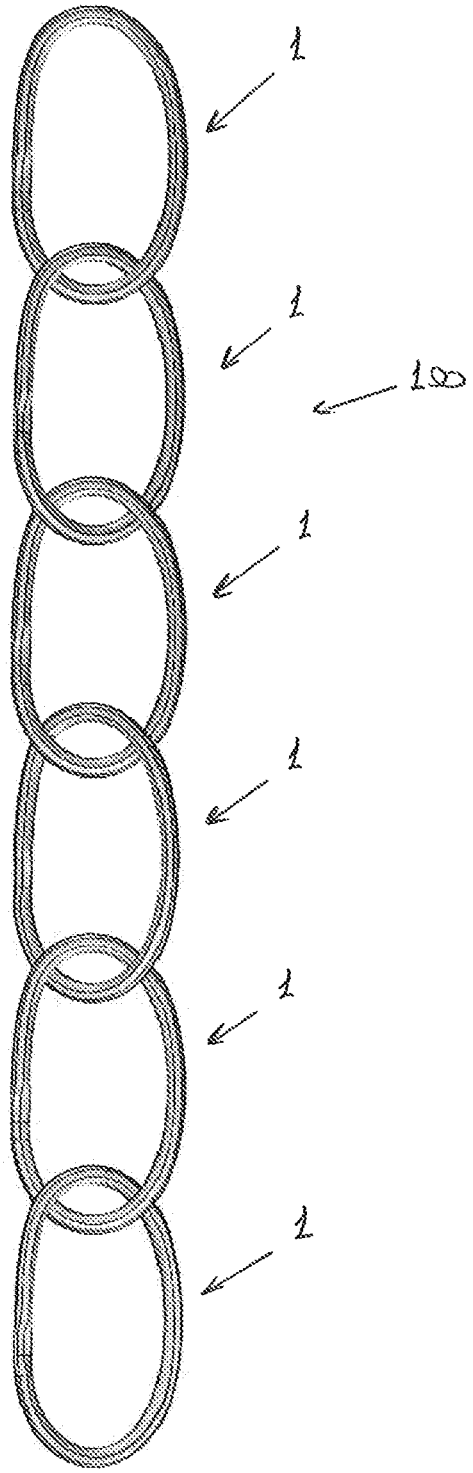
Figure 10B:
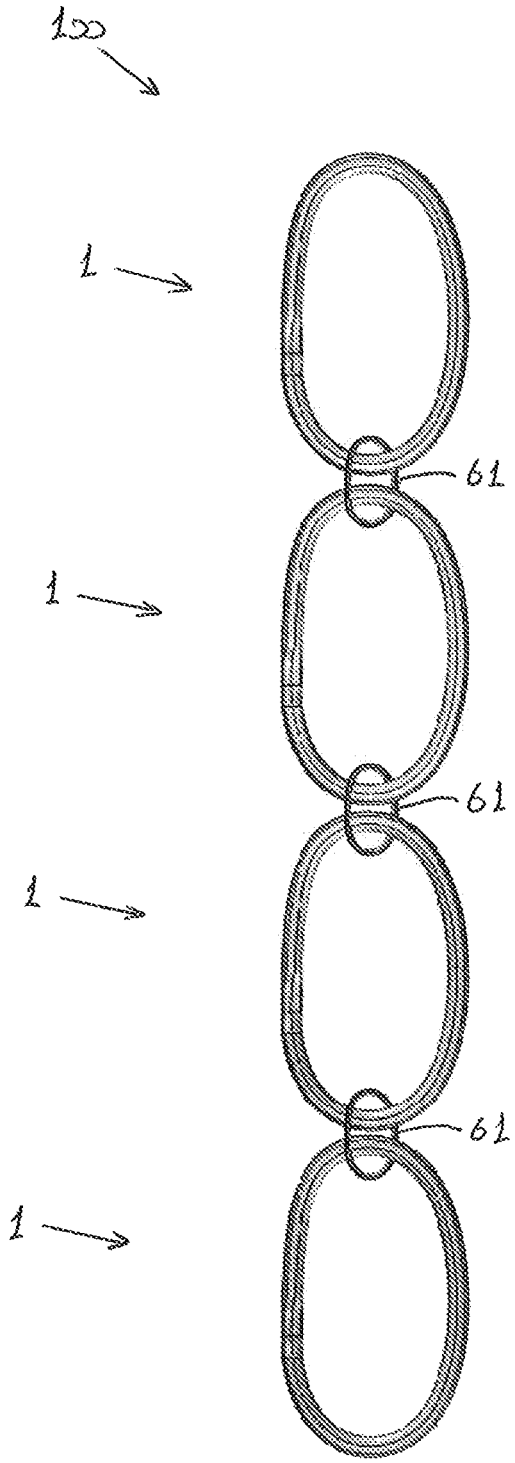
Figure 10C:
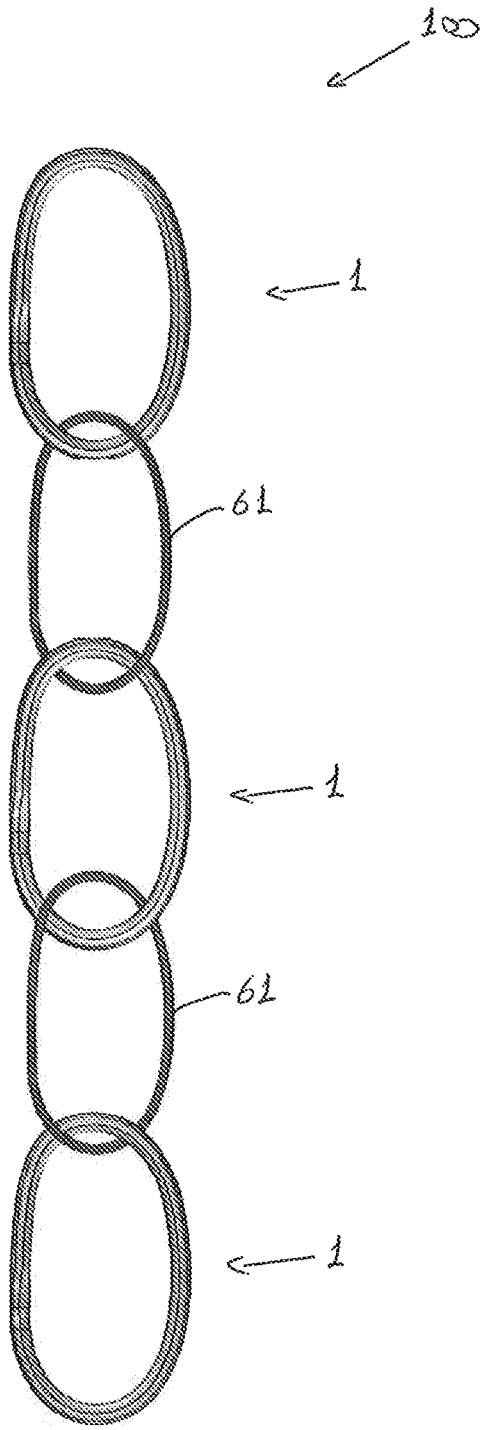

In the examples of FIGS. 10*b*, 10*c*, the bodies 2 of the apparatus 1, closed in the shape of a ring, are joined to one another by interconnection means 61. According to an example, said interconnection means 61 comprise flexible rings, preferably elastic. The dimension of the rings can vary as a function of the weight and of the dimension of the modular apparatus to be obtained.

Also in this case, the elasticity of the interconnection elements 61 allows the various flexible apparatus 1 to move in space with a greater freedom, introducing motor interferences to the exercise.

In the examples indicated above, the modular apparatus 100 can be composed of a number of apparatus 1 chosen by the person as a function of the type of exercise and of the total weight required.

FIG. 10*d* illustrates a further example of the modular apparatus 100 in which the bodies 2 of the various apparatus 1 have the ends 3, 4 joined stably, for example stitched, welded, glued or made integral in any other known way. Also in this variant, the various bodies 2 are linked to one another to form a simple chain.

Clearly, for all the variants that provide for the use of the bodies 2 in the form of annular elements, these latter can also be connected to one another according to other more or less complex geometries to form a variety of different modular apparatus.

In the examples of FIGS. 11*a*-11*d*, other examples of connection of several apparatus 1 are illustrated.

Figure 11A:
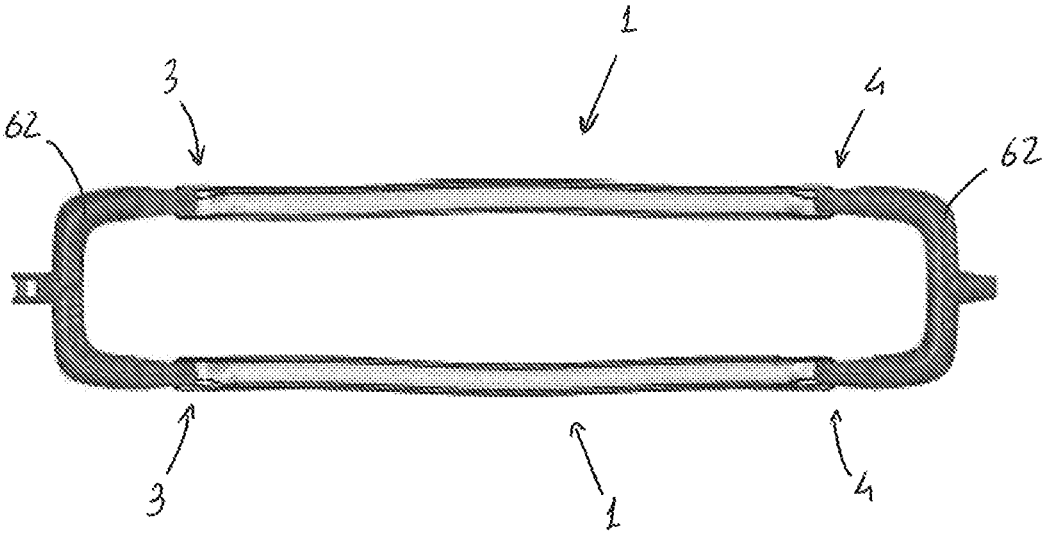
FIGS. 11*a* to 11*d* are schematic front views of the modular apparatus according to other embodiments of the present invention.

In FIG. 11*a* two apparatus 1 are secured to a pair of Y-shaped interconnection elements 62 to form a closed annular element. The interconnection element 62 is in turn connectable to another interconnection element 62 to form a sort of unlinked linear chain as shown in FIG. 11*b*.

Figure 11B:
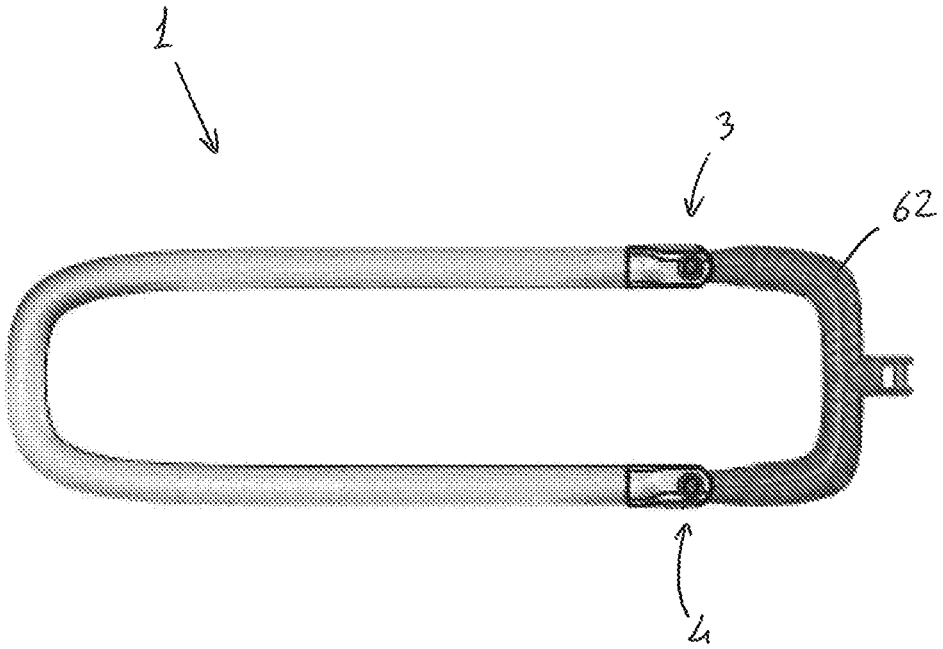
Figure 11C:
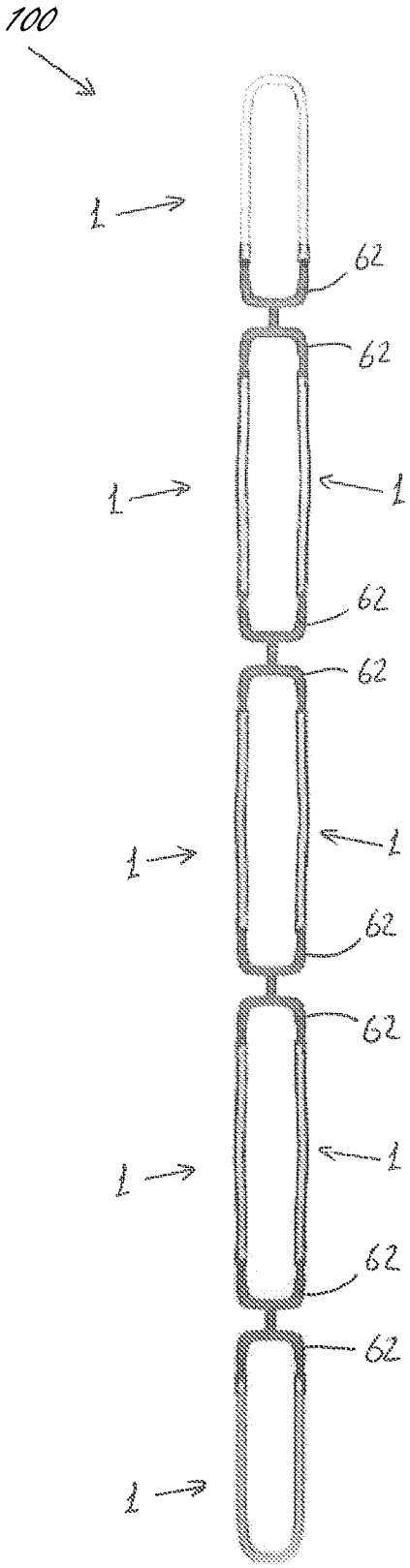
Figure 11D:
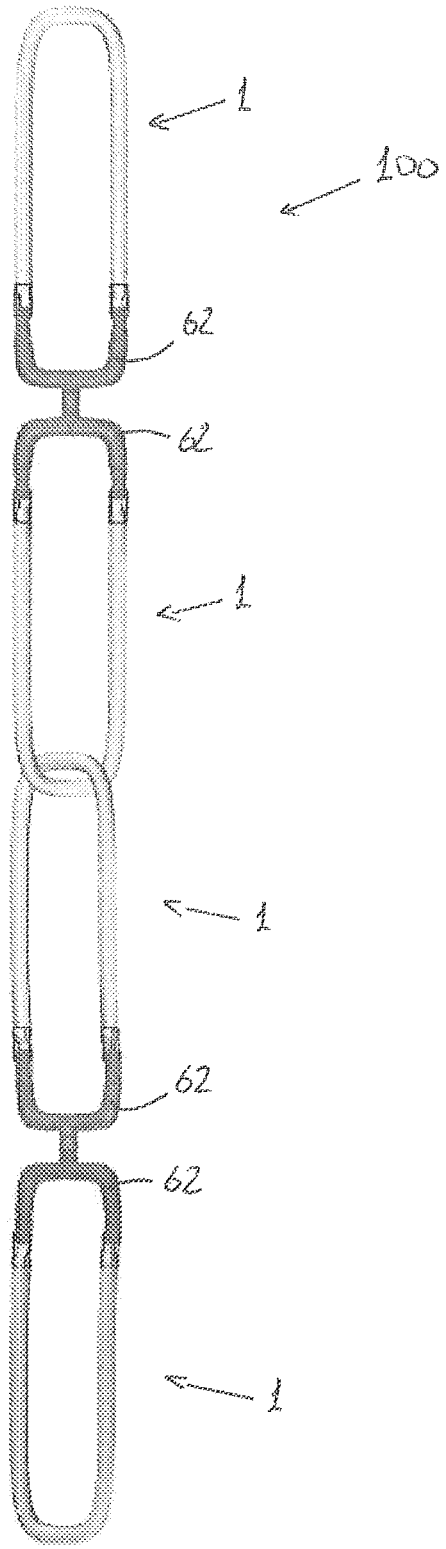

In FIG. 11*b* the ends 3, 4, of the body 2 are secured to the arms of the Y-shaped interconnection element 62 to form an annular element. Said element can be connected to other similar elements through the interconnection element 62, as in the example of FIG. 11*c*, or linked as shown in FIG. 11*d*.

In these variants, the interconnection element 62 is preferably of rigid type. Alternatively, the interconnection element can be made of an elastic material.

Figure 12A:
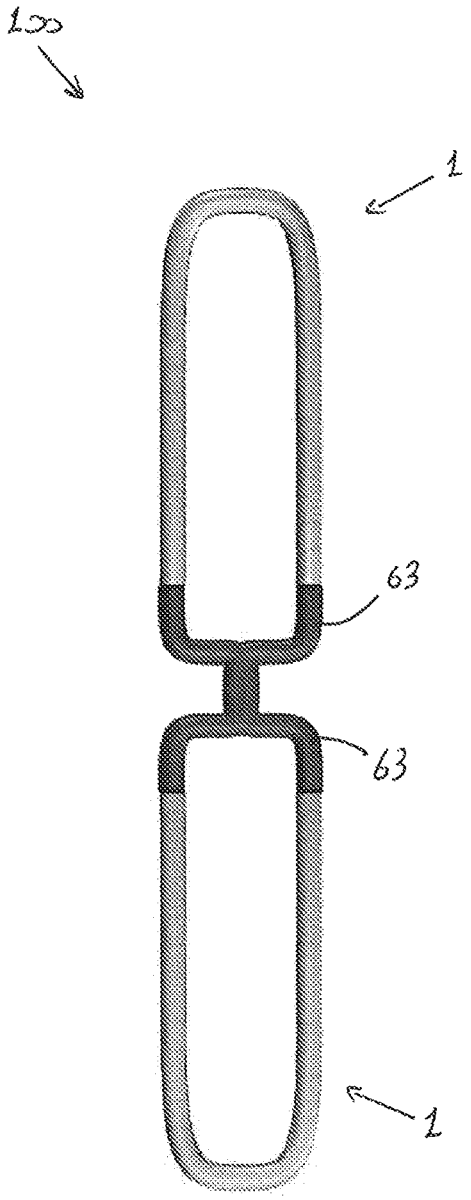
FIGS. 12*a* and 12*b* are schematic front views of the modular apparatus according to other embodiments of the present invention.
Figure 12B:
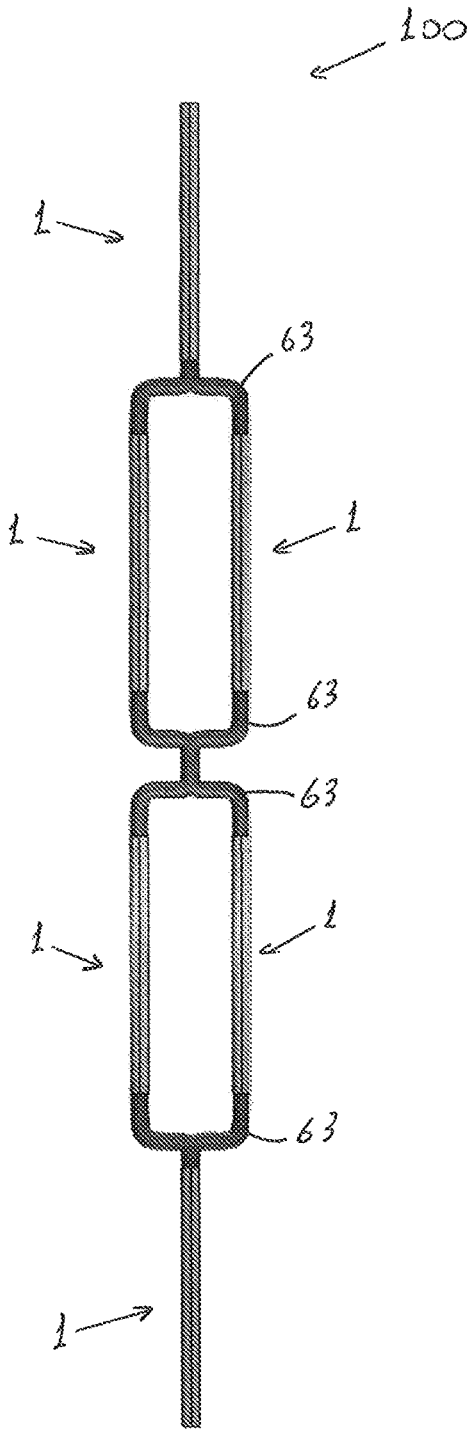

In FIGS. 12*a*, 12*b*, the modular apparatus comprises modular apparatus 100 provided with the aforesaid elastic interconnection element 63, according to two examples of embodiment. In FIG. 12*b* the modular apparatus 100 comprises closed annular elements joined to linear flexible apparatus 1.

The modular apparatus 100, according to any embodiment from those illustrated, can comprise flexible apparatus 1 the same or different in weight and in shape.

This is particularly useful when the modular apparatus is used as progressive mass, linear or non-linear in shape, in place of conventional chains.

In fact, it is possible to put together the various elements, linear or ring-shaped, with a given sequence of different weights that can adapt to the type of exercise performed. For example, it is possible to generate an exponential increase in weight that increases gradually as the apparatus is lifted from the surface on which it rests. To do this, it is sufficient to connect several flexible apparatus 1, each with weight increasing with respect to the previous one, and to lift the apparatus starting from the lightest element.

By lifting the modular apparatus from the heaviest side of the flexible apparatus it is instead possible to obtain an increase of the load that has an asymptotic trend, i.e. which increases less than proportionally with respect to the movement performed.

Other combinations are in any case possible by connecting flexible apparatus 1 of the same or different weight according to further patterns.

Moreover, unlike conventional chains, in the apparatus according to the present invention as the metal parts are spaced from one another, they do not collide, or collide only to a limited extent, that is, in relation to the embodiment. Therefore, in the apparatus according to the present invention as the impacts between metal parts are absent or limited, or produce a muffled sound, its movement is more silent with respect to metal chains, offering considerable and evident advantages to those using the apparatus.

The flexible apparatus 1, just as the modular apparatus 100, is also safety to use with respect to known apparatus such as barbells, dumbbells, discs, kettlebells and the like. In fact, these apparatus according to the invention have no rigid, hard or sharp parts, can be manipulated freely close to the body of the person using them or to other persons nearby. Therefore, these apparatus are suitable for use both by able and trained persons and by beginners, children, the elderly or persons with limited physical capacities.

The invention has been described purely for illustrative and non-limiting purposes, according to some preferred embodiments. Therefore, a person skilled in the art can make modifications or variations, all of which are considered as falling within the scope of protection of the present invention.

The invention claimed is:

1. A flexible sporting apparatus comprising:

an elongated and flexible body that is able to be bent in a ring or in a U, said elongated and flexible body being grippable and connectable to another identical flexible sporting apparatus, wherein a first end and a second end of said elongated and flexible body can be free, joined to each other or connectable to another identical flexible sporting apparatus, said elongated and flexible body comprising:

a plurality of masses, distributed between the first end and the second end of the elongated and flexible body so that their position, in a direction of a length of the elongated and flexible body, is maintained substantially unchanged when the apparatus is moved or bent;

at least one connection element secured integrally to said masses; and a containment element that surrounds said masses and said at least one connection element, wherein the elongated and flexible body has a section of constant shape and dimension between the first end and the second end, and wherein the first end or the second end of the elongated and flexible body, or both, are provided with at least one connection means for connecting to each other, to another flexible apparatus, or to an interconnection element.

2. The flexible sporting apparatus according to claim 1, further comprising:

a plurality of said at least one connection element maintained grouped in a bundle by said containment element.

3. The flexible sporting apparatus according to claim 2, wherein said at least on connection element comprise one or more of the following elements: a wire, a rope, a cable, a tape.

4. The flexible sporting apparatus according to claim 3, wherein a material of the solid and deformable matrix is chosen from a gel, a silicone, an expanded polymer, a natural or synthetic rubber.

5. A modular apparatus comprising at least two flexible apparatus according to claim 1, wherein the at least two flexible apparatus are joined in sequence to form a linear element.

6. The modular apparatus according to claim 5, wherein at least the interconnection element is interposed between at least two ends of the at least two flexible apparatus.

7. The flexible sporting apparatus according to claim 1, wherein said at least one connection element is flexible and extends between said first end and said second end at least for a part of the length of the elongated and flexible body, the position of said masses, in the direction of the length of the elongated and flexible body, being maintained substantially unchanged when the apparatus is moved or bent by said at least one connection element.

8. The flexible sporting apparatus according to claim 1, further comprising a weight per unit of a constant length between the first end and the second end of the elongated and flexible body or variable in a predetermined manner.

9. The flexible sporting apparatus according to claim 1, wherein said masses have the same shape or dimension or weight, or are different from one another.

10. The flexible sporting apparatus according to claim 1, wherein said at least one connection element comprises a solid and deformable matrix in which the masses are dispersed.

11. The flexible sporting apparatus according to claim 1, further comprising, on an outer surface, zones indicated with marks or different colors.

12. The modular apparatus according to claim 1, wherein said at least one connection means and said interconnection element are made of a rigid or elastic material.

13. A modular apparatus comprising at least two flexible apparatus according to claim 1, wherein the at least two flexible apparatus are closed to form an annular element, each elongated and flexible body of the at least two flexible apparatus being linked to one another or being joined by interconnection elements.

14. A flexible sporting apparatus comprising:

an elongated and flexible body that is able to be bent in a ring or in a U, said elongated and flexible body being grippable and connectable to another identical flexible sporting apparatus, wherein a first end and a second end of said elongated and flexible body can be free, joined to each other or connectable to another identical flexible sporting apparatus, said elongated and flexible body comprising:

a plurality of masses, distributed between the first end and the second end of the elongated and flexible body so that their position, in a direction of a length of the elongated and flexible body, is maintained substantially unchanged when the apparatus is moved or bent;

at least one connection element secured integrally to said masses; and a containment element that surrounds said masses and said at least one connection element, wherein the elongated and flexible body has a section of constant shape and dimension between the first end and the second end, and wherein the flexible sporting apparatus further comprises a flexible reinforcing element that extends between said first end and said second end of the elongated and flexible body.

15. A modular apparatus comprising at least two flexible apparatus according to claim 14, wherein the at least two flexible apparatus are closed to form an annular element, each elongated and flexible body of the at least two flexible apparatus being linked to one another or being joined by interconnection elements.

16. A flexible sporting apparatus comprising:

an elongated and flexible body that is able to be bent in a ring or in a U, said elongated and flexible body being grippable and connectable to another identical flexible sporting apparatus, wherein a first end and a second end of said elongated and flexible body can be free, joined to each other or connectable to another identical flexible sporting apparatus, said elongated and flexible body comprising:

a plurality of masses, distributed between the first end and the second end of the elongated and flexible body so that their position, in a direction of a length of the elongated and flexible body, is maintained substantially unchanged when the apparatus is moved or bent;

at least one connection element secured integrally to said masses; and a containment element that surrounds said masses and said at least one connection element, wherein the elongated and flexible body has a section of constant shape and dimension between the first end and the second end, and wherein said masses are joined to one another to form a plurality of linked elements that extends between the ends of the elongated and flexible body, said linked elements being joined to one another at least at their ends by said at least one connection element.

17. The flexible sporting apparatus according to claim 16, wherein said masses are ring or hook shaped, so as to be connected consecutively to one another in a stable or releasable manner.

18. The flexible sporting apparatus according to claim 16, wherein said linked elements comprise a chain.

19. A modular apparatus comprising at least two flexible apparatus, wherein each flexible sporting apparatus comprises:

an elongated and flexible body that is able to be bent in a ring or in a U, said elongated and flexible body being grippable and connectable to another identical flexible sporting apparatus, wherein a first end and a second end of said elongated and flexible body can be free, joined to each other or connectable to another identical flexible sporting apparatus, said elongated and flexible body comprising:

a plurality of masses, distributed between the first end and the second end of the elongated and flexible body so that their position, in a direction of a length of the elongated and flexible body, is maintained substantially unchanged when the apparatus is moved or bent;

at least one connection element secured integrally to said masses; and a containment element that surrounds said masses and said at least one connection element, wherein the elongated and flexible body has a section of constant shape and dimension between the first end and the second end, wherein the at least two flexible apparatus are joined in sequence to form a linear element, and wherein the at least two flexible apparatus are closed to form an annular element, each elongated and flexible body of the at least two flexible apparatus being linked to one another or being joined by interconnection elements.

20. The modular apparatus according to claim 19, wherein said at least two flexible apparatus are equal in weight and in shape or different in weight and/or shape.

* * * * *